US006808545B1

(12) United States Patent
Shuler, Sr.

(10) Patent No.: US 6,808,545 B1
(45) Date of Patent: Oct. 26, 2004

(54) PORTABLE EXHAUST FAN

(76) Inventor: Lynn B. Shuler, Sr., 3883 Old State Rd., Santee, SC (US) 29142

( * ) Notice: Subject to any disclaimer, the term of this patent is extended or adjusted under 35 U.S.C. 154(b) by 0 days.

(21) Appl. No.: 10/392,550

(22) Filed: Mar. 20, 2003

(51) Int. Cl.[7] ..... F24C 15/20

(52) U.S. Cl. ..... 55/385.1; 55/DIG. 36; 99/337; 99/403; 99/408; 126/299 D; 126/299 E; 126/299 R

(58) Field of Search ..... 55/385.1, 385.2, 55/DIG. 36, 493, 496, 337; 99/337, 403, 408; 126/299 D, 399 E, 299 R

(56) References Cited

U.S. PATENT DOCUMENTS 2,866,124 A * 12/1958 Scharmer ..... 55/DIG. 36
5,154,161 A * 10/1992 Rogers et al. ..... 55/DIG. 36
5,628,818 A * 5/1997 Smith et al. ..... 96/30
5,688,297 A * 11/1997 Spengler ..... 55/356
6,058,929 A * 5/2000 Fritz ..... 55/DIG. 36
6,223,741 B1 * 5/2001 Panos ..... 55/DIG. 36
6,309,437 B1 * 10/2001 Jones ..... 55/385.1
6,363,842 B1 * 4/2002 Lin ..... 55/DIG. 36
6,497,738 B2 * 12/2002 Lin ..... 55/DIG. 36

* cited by examiner

*Primary Examiner*—Duane Smith
*Assistant Examiner*—Minh-Chau T. Pham

(57) ABSTRACT

A portable exhaust fan is disclosed. The portable exhaust fan has a hood, two adjustable length hood end elements, four adjustable legs, a grease trap tray connected to the hood, a fan enclosure connected to the grease trap tray with a motorized fan mounted within the enclosure, a charcoal filter element connected to the fan enclosure, and a top grill connected to the charcoal filter element. The portable exhaust fan has particular utility in connection with providing suitable air cleaning and air exhaust for cooking appliances such as cooktops, ranges, electric griddles, fry pans, and deep fryers in different locations.

20 Claims, 2 Drawing Sheets

PORTABLE EXHAUST FAN

BACKGROUND OF THE INVENTION

1. Field of the Invention

The present invention relates to a portable exhaust fan for use in connection with cooktops, ranges, electric griddles, fry pans, deep fryers, and other countertop appliances. The portable exhaust fan has particular utility in connection with providing suitable air cleaning and air exhaust for cooking appliances in different locations.

2. Description of the Prior Art

Portable exhaust fans are desirable for providing suitable air cleaning and air exhaust for cooking appliances in different locations.

The use of fans and air cleaners is known in the prior art. For example, U.S. Pat. No. 4,900,346 to Lutz discloses a portable air filtration device. However, the air filtration device of the Lutz '346 patent does not provide a grease trap, and has the further drawback of a design that is not adjustable and is unsuitable for use as a kitchen exhaust fan.

U.S. Pat. No. 6,264,727 to Elmore discloses a filter fan. However, the filter fan of the Elmore '727 patent does not provide a grease trap, and additionally does not provide a design that is adjustable or suitable for use as a kitchen exhaust fan.

U.S. Pat. No. 3,785,124 to Gaylord discloses a pollution-free kitchen ventilator. However, the Gaylord '124 patent does not provide a kitchen exhaust fan that is adjustable, and can not provide a portable exhaust fan for use with fry pans and the like.

U.S. Pat. No. 3,747,300 to Knudson discloses a portable electrostatic air cleaner. However, the air cleaner of the Knudson '300 patent does not provide a grease trap, and additionally does not provide a design that is adjustable or suitable for use as a kitchen exhaust fan.

U.S. Pat. No. 4,483,316 to Fritz et al. discloses an air ventilation system. However, the Fritz '316 patent does not provide a kitchen exhaust fan that is adjustable, and can not provide a portable exhaust fan for use with fry pans and the like.

Lastly, U.S. Pat. No. 6,276,358 to Brin, Jr. et al. discloses a vertically adjustable ventilation hood system for a cooking appliance. However, the hood system of the Brin, Jr. '358 patent does not provide a grease trap, and has the additional deficiency of a lack of portability for use with fry pans and the like.

While the above-described devices fulfill their respective, particular objectives and requirements, the aforementioned patents do not describe a portable exhaust fan that allows suitable air cleaning and air exhaust for cooking appliances in different locations. The prior art patents make no provision for trapping grease, adjustability, and portability.

Therefore, a need exists for a new and improved portable exhaust fan that can be used for providing suitable air cleaning and air exhaust for cooking appliances in different locations. In this regard, the present invention substantially fulfills this need. In this respect, the portable exhaust fan according to the present invention substantially departs from the conventional concepts and designs of the prior art, and in doing so provides an apparatus primarily developed for the purpose of providing suitable air cleaning and air exhaust for cooking appliances in different locations.

SUMMARY OF THE INVENTION

In view of the foregoing disadvantages inherent in the known types of fans and air cleaners now present in the prior art, the present invention provides an improved portable exhaust fan, and overcomes the above-mentioned disadvantages and drawbacks of the prior art. As such, the general purpose of the present invention, which will be described subsequently in greater detail, is to provide a new and improved portable exhaust fan and method which has all the advantages of the prior art mentioned heretofore and many novel features that result in a portable exhaust fan which is not anticipated, rendered obvious, suggested, or even implied by the prior art, either alone or in any combination thereof.

To attain this, the present invention essentially comprises a portable exhaust fan, comprising an adjustable hood, at least three legs connected to the adjustable hood, a grease trap tray connected to the adjustable hood, a fan enclosure connected to the grease trap tray, a motorized fan mounted within the fan enclosure, a filter element connected to the fan enclosure, and a top grill connected to the filter element.

In one embodiment, the present invention comprises a portable exhaust fan, comprising an adjustable hood, four adjustable legs connected to the adjustable hood, a grease trap tray connected to the adjustable hood, a fan enclosure connected to the grease trap tray, a fan mounted within the fan enclosure, a fan motor connected to the fan, a power cord connected to the fan motor, a filter element connected to the fan enclosure, and a top grill connected to the filter element.

In another embodiment, the present invention comprises a portable exhaust fan, comprising a hood, two adjustable length hood end elements connected to the hood, two adjustable legs connected to each hood end element, a grease trap tray having a grease trap element with the grease trap tray connected to the hood, a fan enclosure connected to the grease trap tray, a fan mounted within the fan enclosure, a fan motor connected to the fan, a power cord connected to the fan motor, a charcoal filter element connected to the fan enclosure, and a top grill connected to the charcoal filter element.

There has thus been outlined, rather broadly, the more important features of the invention in order that the detailed description thereof that follows may be better understood and in order that the present contribution to the art may be better appreciated.

The invention may also include adjustment slits and stops, wing nuts, screws, and other attachments. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable exhaust fan that has all of the advantages of the prior art fans and air cleaners and none of the disadvantages.

It is another object of the present invention to provide a new and improved portable exhaust fan that may be easily and efficiently manufactured and marketed.

An even further object of the present invention is to provide a new and improved portable exhaust fan that has a low cost of manufacture with regard to both materials and labor, and which accordingly is then susceptible of low prices of sale to the consuming public, thereby making such portable exhaust fan economically available to the buying public.

Still another object of the present invention is to provide a new portable exhaust fan that provides in the apparatuses and methods of the prior art some of the advantages thereof, while simultaneously overcoming some of the disadvantages normally associated therewith.

Even still another object of the present invention is to provide a portable exhaust fan for providing suitable air cleaning for cooking appliances in different locations. This allows an individual to cook on various counters with various different appliances without grease spreading throughout the room.

Still yet another object of the present invention is to provide a portable exhaust fan for providing suitable air exhaust for cooking appliances in different locations. This makes it possible to quickly move air away from cooking appliances in various locations to maintain clean air at a comfortable temperature for the individual doing the cooking.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
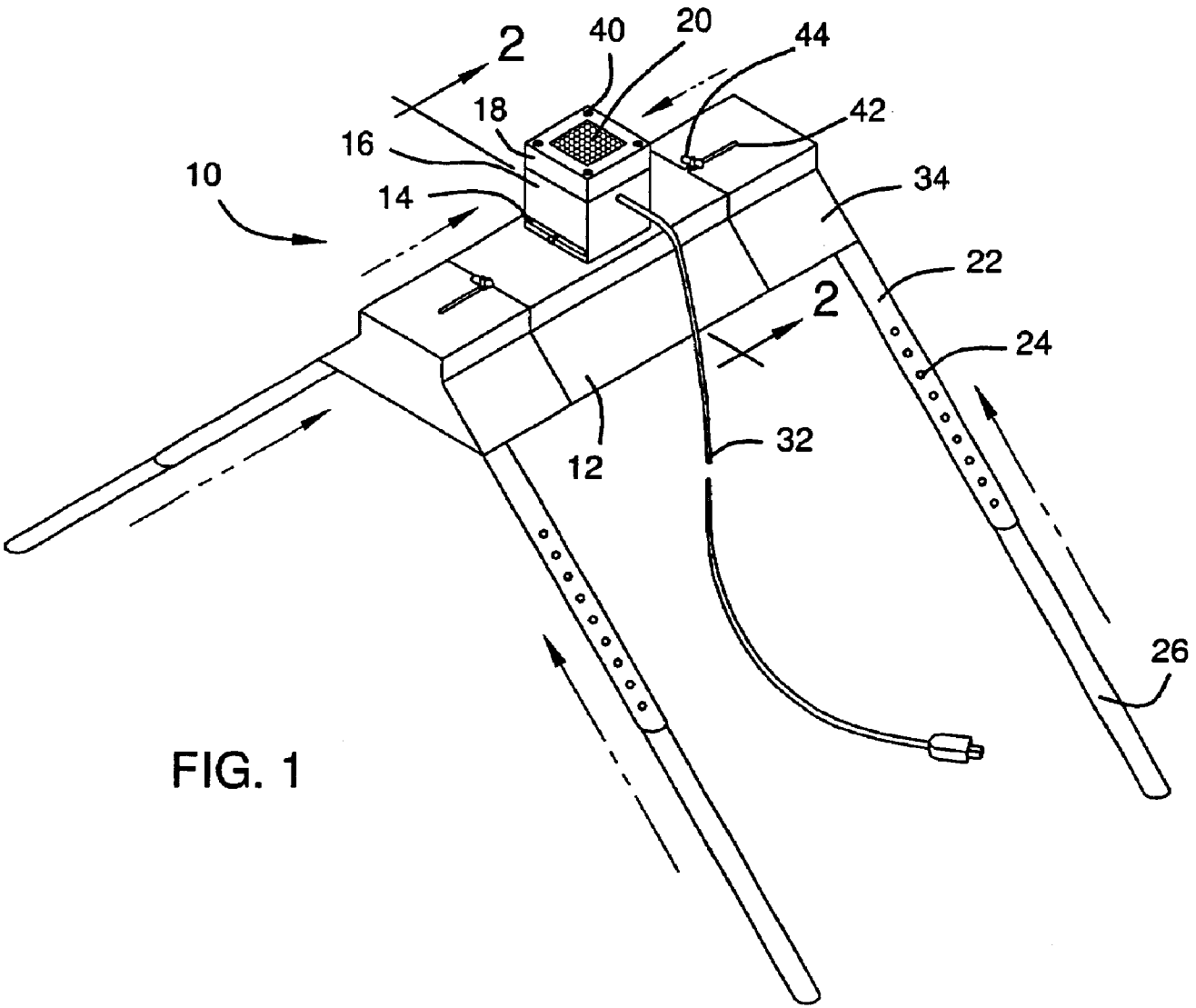
FIG. 1 is an isometric perspective view of the preferred embodiment of the portable exhaust fan constructed in accordance with the principles of the present invention.
Figure 2:
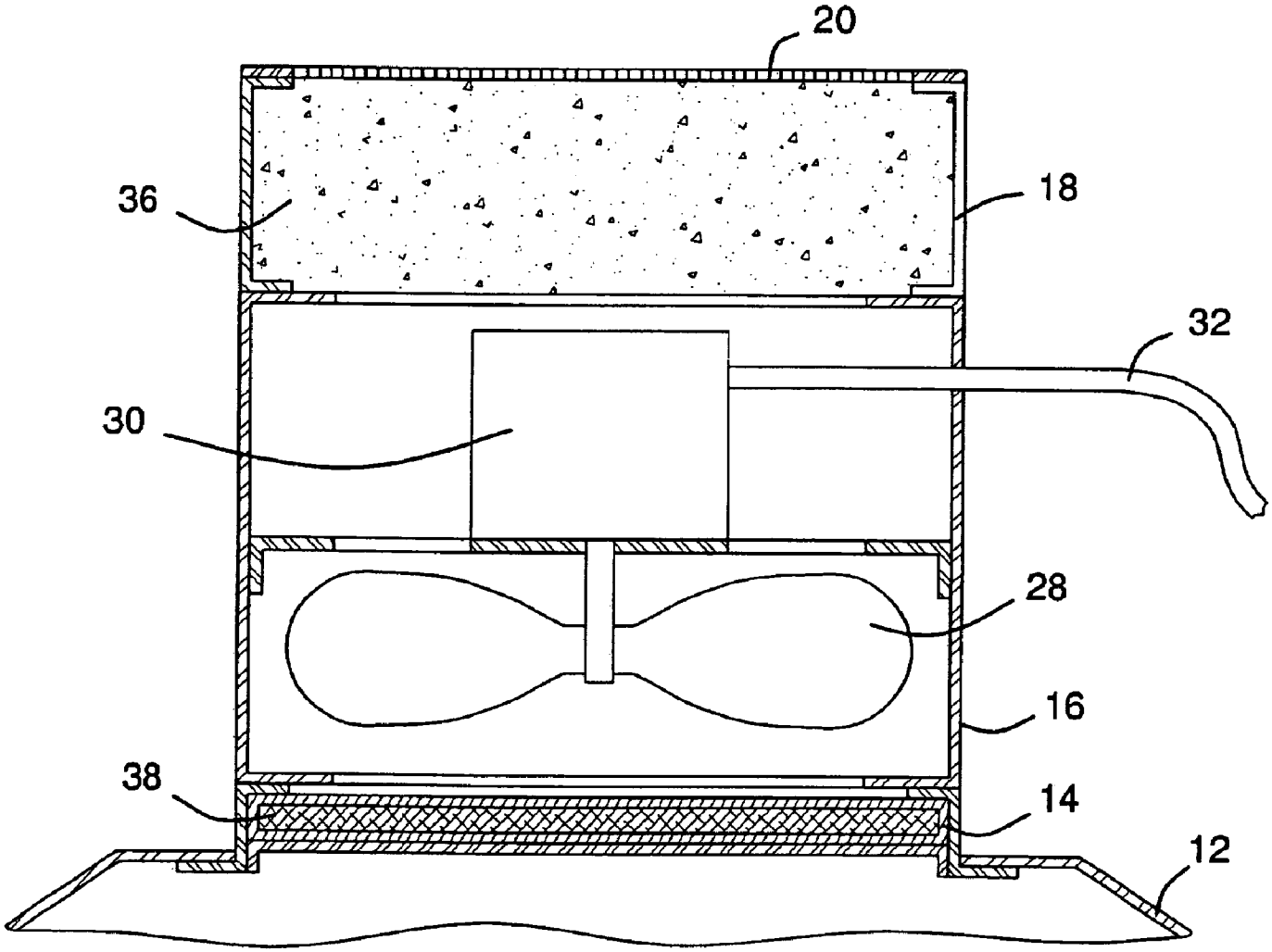
FIG. 2 is a side elevational cross-sectional view of the portable exhaust fan of the present invention illustrated in FIG. 1 and taken along the line 2—2.

Referring now to the drawings, and particularly to FIGS. 1–2, a preferred embodiment of the portable exhaust fan of the present invention is shown and generally designated by the reference numeral 10.

In FIG. 1, a new and improved portable exhaust fan 10 of the present invention for providing suitable air cleaning and air exhaust for cooking appliances in different locations is illustrated and will be described. More particularly, in this embodiment the portable exhaust fan 10 comprises a hood 12, two adjustable length hood end elements 34 connected to the hood 12, four adjustable legs each comprising a top outer leg 22 having a plurality of adjustment stops 24 and a bottom inner leg 26 connected to the top outer leg 22 that is connected to a hood end element 34, a grease trap element within a grease trap tray 14 connected to the hood 12, a fan enclosure 16 connected to the grease trap tray 14 with a fan mounted within the fan enclosure 16, a fan motor connected to the fan, and a power cord 32 connected to the fan motor, charcoal within a filter element 18 connected to the fan enclosure 16, and a top grill 20 connected to the filter element 18 with a plurality of screws 40. In some embodiments, the grease trap element comprises metal foil. Each adjustable length hood end element 34 may define an adjustment slit 42, with a wing nut 44 connecting each adjustable length hood end element 34 to the hood 12.

FIG. 2 is a cross-sectional view of the portable exhaust fan of the present invention, and illustrates the hood 12, a grease trap element 38 within the grease trap tray 14 connected to the hood 12, a fan enclosure 16 connected to the grease trap tray 14, a fan 28 mounted within the fan enclosure 16, a fan motor 30 connected to the fan 28, a power cord 32 connected to the fan motor 30, charcoal 36 within a filter clement 18 connected to the fan enclosure 16, and a top grill 20 connected to the filter element 18.

The portable exhaust fan is a modified kitchen exhaust fan design. It is configured so that it may be employed on a portable basis. As with conventional products of this nature, it can feature a 125 volt AC centrifugal blower or related element known to those of skill in the art. It can be designed for use with different voltages for different countries. In one embodiment, it comprises metal and is mounted on an adjustable length element that features a maximum extended length of about 36 inches. It is supported at its ends by pairs of angled, two-piece, telescoping legs that can also be adjusted to a maximum length of about 36 inches. Different embodiments can comprise different lengths. In one embodiment, its inlet is equipped with a suitable metal foil grease trap, while its outlet employs an activated charcoal filter element.

The portable exhaust fan fulfills the need for an alternative to built-in kitchen exhaust fans. The appealing features of the portable exhaust fan include its small storage size, ease of use, versatility, and convenience. The acquisition of this product represents a much less costly investment than installing or even replacing a conventional built-in exhaust fan. In addition to use with cooktops and ranges, it may be employed with electric griddles, fry pans, deep fryers, and other countertop appliances.

In one embodiment, the portable exhaust fan comprises an adjustable hood, at least three legs connected to the adjustable hood, a grease trap tray connected to the adjustable hood, a fan enclosure connected to the grease trap tray, a motorized fan mounted within the fan enclosure, a filter element connected to the fan enclosure, and a top grill connected to the filter element.

In another embodiment, the portable exhaust fan comprises an adjustable hood, four adjustable legs connected to the adjustable hood, a grease trap tray connected to the adjustable hood, a fan enclosure connected to the grease trap tray, a fan mounted within the fan enclosure, a fan motor connected to the fan, a power cord connected to the fan motor, a filter element connected to the fan enclosure, and a top grill connected to the filter element.

In still another embodiment, the portable exhaust fan comprises a hood, two adjustable length hood end elements connected to the hood, two adjustable legs connected to each hood end element, a grease trap tray having a grease trap element with the grease trap tray connected to the hood, a fan enclosure connected to the grease trap tray, a fan mounted within the fan enclosure, a fan motor connected to the fan, a power cord connected to the fan motor, a charcoal filter element connected to the fan enclosure, and a top grill connected to the charcoal filter element.

In some embodiments, the legs are telescopic and each adjustable leg comprises a top outer leg having a plurality of adjustment stops and a bottom inner leg connected to the top outer leg.

In certain embodiments, the portable exhaust fan further comprises a plurality of screws connecting the top grill to the charcoal filter element. In some embodiments, the grease trap element comprises metal foil. In certain embodiments, each adjustable length hood end element defines an adjustment slit. In some embodiments, the portable exhaust fan further comprises at least one wing nut connecting each adjustable length hood end element to the hood.

In use, it can now be understood that the portable exhaust fan of the present invention has particular utility in connection with providing suitable air cleaning and air exhaust for cooking appliances in different locations.

While a preferred embodiment of the portable exhaust fan has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy heat resistant and fire resistant material may be used, such as stainless steel, galvanized steel, aluminum, or painted steel. Also, the legs may be made of metal, composite material, or similar sturdy material. And although providing suitable air cleaning and air exhaust for cooking appliances in different locations has been described, it should be appreciated that the portable exhaust fan herein described is also suitable for other air cleaning and air exhaust applications such as work stations where heating or welding operations, etc., are performed. Furthermore, a wide variety of hood shapes and configurations may be used instead of that described. In addition, it is to be understood that the various described embodiments may be combined.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable exhaust fan, comprising:

an adjustable hood having a length, wherein said length of said adjustable hood is adjustable by a user;

at least three legs connected to said adjustable hood;

a grease trap tray connected to said adjustable hood;

a fan enclosure connected to said grease trap tray;

a motorized fan mounted within said fan enclosure;

a filter element connected to said fan enclosure; and a top grill connected to said filter element.

2. The portable exhaust fan of claim 1, wherein each said leg is adjustable.

3. The portable exhaust fan of claim 1, wherein each said leg comprises a top outer leg having a plurality of adjustment stops and a bottom inner leg connected to said top outer leg.

4. The portable exhaust fan of claim 1, wherein said motorized fan comprises a fan, a motor connected to said fan, and a power cord connected to said motor.

5. The portable exhaust fan of claim 1, wherein said adjustable hood comprises a hood and at least one adjustable length hood end element slidably connected to said hood.

6. The portable exhaust fan of claim 1, wherein said filter element comprises charcoal.

7. The portable exhaust fan of claim 1, wherein said grease trap tray comprises a grease trap element.

8. The portable exhaust fan of claim 7, wherein said grease trap element comprises metal foil.

9. A portable exhaust fan, comprising:

an adjustable hood having a length, wherein said length of said adjustable hood is adjustable by a user;

four adjustable legs connected to said adjustable hood;

a grease trap tray connected to said adjustable hood;

a fan enclosure connected to said grease trap tray;

a fan mounted within said fan enclosure;

a fan motor connected to said fan;

a power cord connected to said fan motor;

a filter element connected to said fan enclosure; and a top grill connected to said filter element.

10. The portable exhaust fan of claim 9, wherein said adjustable hood comprises a hood and two adjustable length hood end elements slidably connected to said hood.

11. The portable exhaust fan of claim 9, wherein each said adjustable leg comprises a top outer leg having a plurality of adjustment stops and a bottom inner leg connected to said top outer leg.

12. The portable exhaust fan of claim 9, wherein said filter element comprises charcoal.

13. The portable exhaust fan of claim 9, wherein said grease trap tray comprises a grease trap element.

14. The portable exhaust fan of claim 13, wherein said grease trap element comprises metal foil.

15. A portable exhaust fan, comprising:

a hood having opposing ends;

two adjustable length hood end elements having opposing ends with one end slidably connected to said opposing ends of said hood;

two adjustable legs connected to each of said hood end elements;

a grease trap tray having a grease trap element, said grease trap tray connected to said hood;

a fan enclosure connected to said grease trap tray;

a fan mounted within said fan enclosure;

a fan motor connected to said fan;

a power cord connected to said fan motor;

a charcoal filter element connected to said fan enclosure; and a top grill connected to said charcoal filter element.

16. The portable exhaust fan of claim 15, wherein each said adjustable leg comprises a top outer leg having a plurality of adjustment stops and a bottom inner leg connected to said top outer leg.

17. The portable exhaust fan of claim 15, further comprising a plurality of screws connecting said top grill to said charcoal filter element.

18. The portable exhaust fan of claim 15, wherein each of said adjustable length hood end elements defines an adjustment slit therein.

19. The portable exhaust fan of claim 15, further comprising at least one wing nut connecting each of said adjustable length hood end elements to said hood.

20. The portable exhaust fan of claim 15, wherein said grease trap element comprises metal foil.

* * * * *